US006390839B2

(12) United States Patent
Miwa

(10) Patent No.: US 6,390,839 B2
(45) Date of Patent: May 21, 2002

(54) TERMINAL ASSEMBLY WITH DISCHARGE CONTACTS AND CONNECTOR ASSEMBLY THEREOF

(75) Inventor: Takeya Miwa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/796,602

(22) Filed: Mar. 2, 2001

(30) Foreign Application Priority Data

Mar. 3, 2000 (JP) ..... 2000-059052

(51) Int. Cl.[7] ..... H01R 13/53
(52) U.S. Cl. ..... 439/181; 439/88; 439/924.1
(58) Field of Search ..... 439/88, 181, 924.1, 439/186, 851, 852

(56) References Cited

U.S. PATENT DOCUMENTS 5,356,300 A 10/1994 Costello et al. ..... 439/101
5,480,320 A * 1/1996 Saimoto ..... 439/852
5,951,339 A * 9/1999 Chaillot et al. ..... 439/852
5,997,327 A * 12/1999 Vergne et al. ..... 439/181
6,068,498 A * 5/2000 Strack ..... 439/181
6,217,356 B1 * 4/2001 Davis et al. ..... 439/181

FOREIGN PATENT DOCUMENTS

EP 0717469 A2 9/1996

* cited by examiner

*Primary Examiner*—Khiem Nguyen
*Assistant Examiner*—Hae Moon Hyeon
(74) *Attorney, Agent, or Firm*—Finnegan, Henderson, Farabow, Garrett, & Dunner, L.L.P.

(57) ABSTRACT

A pair of terminals includes contact parts to be contacted with each other for conduction. Respective one of the pair of terminals has respective one of discharge parts formed integrally thereto. The discharging parts are contacted with each other before contacting the contact parts. The discharging parts are disengaged from each other after disengaging the contact parts.

5 Claims, 3 Drawing Sheets

TERMINAL ASSEMBLY WITH DISCHARGE CONTACTS AND CONNECTOR ASSEMBLY THEREOF

BACKGROUND OF THE INVENTION

The present invention relates to a terminal assembly, and, more particularly, to a terminal assembly employed for male and female connectors to be mated and connected each other.

A connector assembly has a female and male connector mated with each other for connection. The female connector has a male connecting terminal accommodated and fixed in a female connector housing. The male connecting terminal is disposed at its distal end to protrude into a hood of the female housing.

On the other hand, the male connector has a female connecting terminal accommodated and fixed in a male connector housing. The female terminal is formed at its distal end in a tubular shape, in which the male terminal is to be inserted from its distal end. The female terminal has a contact spring piece formed at its distal end, the spring piece being folding back diagonally in the tubular space.

In the connector of the structure, when mating the male and female connectors, the male terminal is inserted in the end of female connector from its end to be contacted with the spring piece, so that conduction is achieved.

SUMMARY OF THE INVENTION

In the above-described connector assembly, however, when the female and male connectors in conduction are mated with each other, the distal ends of the male and female terminals come into contact with each other at first, and an arc discharge generates at contacts to deteriorate or damage the contacts. When disengaging the connectors, the distal ends of male and female terminals last detach from each other, and an arc discharge generates at the distal ends to deteriorate or damage the contacts.

The deterioration or damage generates to the contacts prevents the contacts of the male and female terminals from good conduction, and connector is degraded in reliability.

An object of the present invention provides a terminal assembly with contact protection function which makes ends of connecting terminals to be connected with each other prevented from deterioration or damage for protecting the ends of both the connecting terminals.

According to a first aspect of the invention, there is provided a terminal assembly. The assembly includes a pair of terminals including contact parts to be contacted with each other for conduction. Respective one of the pair of terminals has respective one of discharge parts formed integrally thereto. The discharging parts are contacted with each other before contacting the contact parts. The discharging parts are disengaged from each other after disengaging the contact parts.

Preferably, the respective one of the discharge members is a spring piece extending forward from respective one of side parts of the pair of the terminals in a mating direction.

According to the second aspect of the invention, a terminal assembly includes a first terminal having a first contact. The first terminal has a first discharge part with a second contact extending from the first terminal. The second contact is displaced from the first contact at a first displacement S1. The assembly includes a second terminal to be mated with the first terminal for conduction. The second terminal has a third contact to be contacted with the first contact. The second terminal has a second discharge part with a fourth contact extending from the second terminal. The fourth contact is to be contacted with the second contact. The fourth contact is displaced from the third contact at a second displacement S2. A relationship of the first displacement S1 and the second displacement S2 is that S1+S2>0.

Preferably, the first terminal has a protrusion including the first contact at a distal end thereof.

According to a third aspect of the invention, a connector assembly is adapted for a terminal assembly according to the second aspect. A first connector includes a first housing accommodating the first terminal. A second connector includes a second housing to be mated with the first housing. The second housing accommodates the second terminal.

According to the aspects, the discharge members provided to respective one of the pair of terminal are contacted with each other before contacting the contact parts of both the terminals. When disengaging the terminals, the discharging members are disengaged from each other after disengaging the contact parts. If an arc discharge generates between the discharge members, detrimental effect to the contact parts is prevented from extending. Thus, the contact parts of the terminals do not have deterioration and damage due to the arc discharge, and the terminals as well as the connectors are improved in reliability.

The discharge members are spring pieces extending from a pair of side parts of the terminals, and the discharge members are at a distance apart from each other, so that an arc discharge effect is prevented from extending to the contact parts.

The discharge members securely contact before contacting the contact parts and the discharge members securely contact at disengagement of the contact parts. Thus, discharge members are securely disengaged from each other after disengaging the contact parts, and detrimental effect to the contact parts is prevented from extending.

BRIEF DESCRIPTION OF THE ACCOMPANYING DRAWINGS

DETAILED DESCRIPTION OF THE PREFERRED EMBODIMENTS

An embodiment of the present invention will hereby be explained with reference to the drawings.

Figure 1:
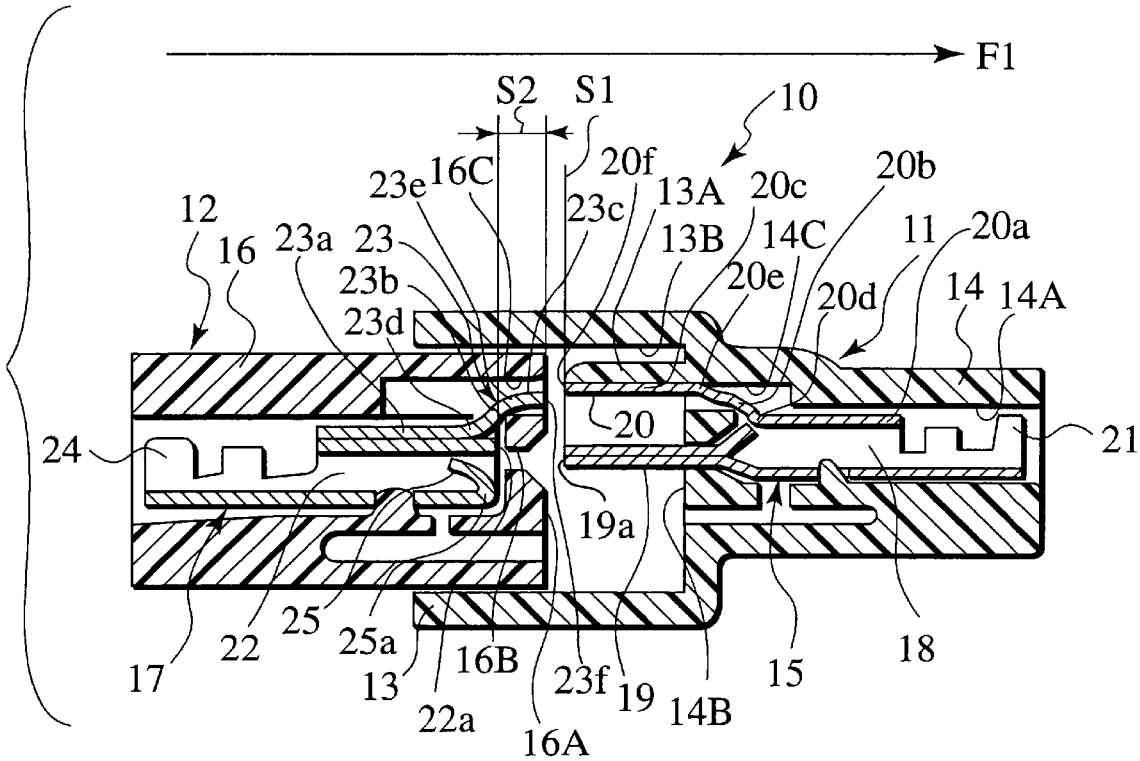
FIG. 1 is a sectional view of a connector assembly of an embodiment, for which connecting terminals of the invention are adapted.

As shown on FIG. 1, a connector assembly 10 includes a female connector 11 and a male connector 12. The female connector 11 has a male connecting terminal 15 accommodated and disposed in a female housing 14 formed with a fit-in hood part 13 at a front end of the housing 14. The male connector 12 has a female connecting terminal 17 accommodated and disposed in a male housing 16 to be fitted in a hood 13 of the female housing 14 at a front end of the housing 16.

Figure 2:
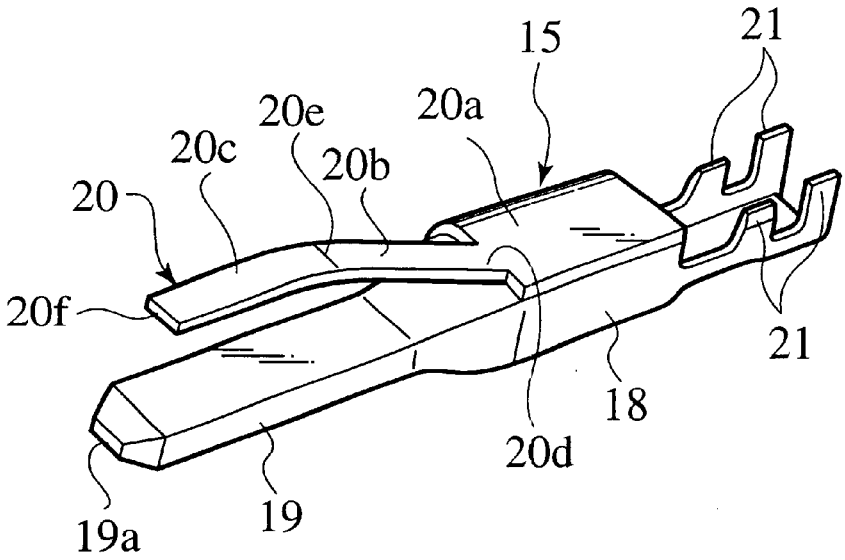
FIG. 2 is a perspective view of a male connecting terminal of an embodiment.

The male terminal 15, as shown on FIGS. 1 and 2, a male terminal body 18 supported by the female housing 14, a contact protrusion 19 provided at a front end of the terminal body 18, a dummy tab 20, as a dummy contact, extending forward from a side part at the front end of the terminal body 18 in substantially parallel with and at a predetermined distance apart from the protrusion 19. In the embodiment, the tab 20 and the protrusion 19 are set each other at substantially equal length. The tab 20, as shown on FIG. 2, includes a base part 20*a*, a first part 20*b* extending diagonally from the base part 20*a* to be apart from the protrusion 19, and a second part 20*c* extending from the first part 20*b* in substantially parallel with the protrusion 19. Between the base part 20*a* and the first part 20*b*, a third part 20*d* is bent. Between the first part 20*b* and the second part 20*c*, a fourth part 20*e* is bent. The second part 20*c* and the protrusion 19 include ends 20*f*, 19*a* in substantially accordance with each other in a mating direction F1.

The male terminal body 18 includes wire holding pieces 21 for holding a wire (not shown on Figs.) at a rear part thereof.

The female housing 14 to accommodate the male terminal 15 of the structure has a terminal accommodation space 14A inside, the space 14A accommodating a male terminal body 18 of the male terminal 15. The protrusion 19 of the male terminal 15 passes through an intermediate wall 14B to protrude into the hood part 13, the walls 14B separating the space 14A and a space in the hood part 13.

The dummy tab 20 of the male terminal 15 protrudes into the hood part 13 through an insertion hole 14*c* formed to the intermediate wall 14B. The hood part 13 includes a tab holding wall 13A holding the tab 20 along an outer side of the tab 20 therein. The wall 13A and an outer wall of the hood part 13 has an insertion space 13B formed therebetween for inserting a front end of the male housing 16 of the male connector 12.

The male housing 16 has a front wall 16A at its front end to hold the female terminal 17 to be inserted from its rear end. The front wall 16A has a protrusion guide hole 16B provided therethrough at its central part in its traverse direction. The front wall 16A includes a tab insertion hole 16*c* made at a periphery thereof for inserting the wall 13A formed to the female housing 14 and a tab 20 held by the wall 13A.

Figure 3:
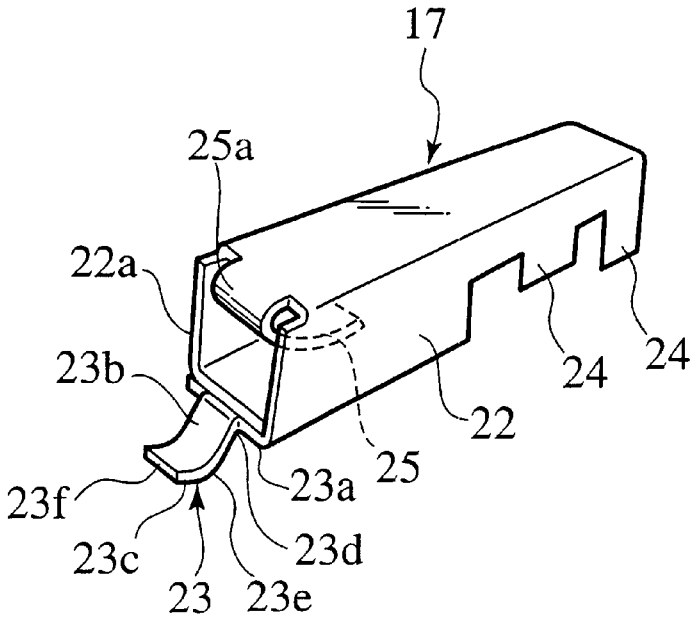
FIG. 3 is a perspective view of a female connecting terminal of an embodiment.

The female terminal 17 to be accommodated in the male housing 16, as shown on FIGS. 1 and 3, includes a female terminal body 22 in a substantially rectangularly tubular shape, which is accommodated and held in the male housing 16, a dummy spring 23, as a dummy contact, protruding forwardly diagonally outward from a side part at a front end of the female terminal body 22, and pairs of terminal holding pieces 24 formed at a rear part of the female terminal body 22.

The female terminal body 22 includes a contact spring 25 as a contact part, being folded back inwardly at a proximal end 25*a*, at a periphery of a front end opening part thereof. When mating the female and male connectors 11, 12, the spring 25 is to be contacted with the spring 19. The spring 23, configured to protrude froward from the female terminal body 22, is disposed in the insertion hole 16c formed to the male housing 16 so as to be contacted with the tab 20 to be passed through the hole 16*c*. When mating both the connectors 11, 12, the spring 23 and the tab 20 come to contact before the protrusion 19 and the spring 25 do. The spring 23 includes a base part 23*a* on the terminal body 22, a first part 23*b* extending diagonally outward from the base part 23*a*, and a second part 23*b* extending from the first part 23*a* in substantially parallel with the terminal body 22. The base part 23*a* and the first part 23*b* have a third part 23*d* bent therebetween. The first part 23*b* and the second part 23*c* have a fourth part 23*e* bent therebetween. The second part 23*c* has a distal end 23*f* positioned in front of a proximal end 25*a*.

The distal end 19*a* of protrusion 19 is first contacted with the proximal end 25*a* of contact spring 25 or the front end 22*a* of female terminal body 22 in dependence on a bent state of the spring 25. The distal end 20*f* of tab 20 is first contacted with the distal end 23*f* of spring 23.

In the mating direction F1 on FIG. 1, the distal end 20*f* of tab 20 is displaced from the distal end 19*a* at a displacement S1 of substantially zero. If the distal end 20*f* is positioned at an opposite side to the male terminal body 18 relative to the distal end 19*a*, the displacement S1 is positive. If the end 20*f* is positioned at an identical side with the male terminal body 18 relative to the end 19*a*, the displacement S1 is negative.

On the other hand, in the mating direction F1, the distal end 23*f* of spring 23 is displaced from the proximal end 25*a* at a positive displacement S2. If the end 23*f* is positioned at an opposite side to the female terminal body 22 relative to the proximal end 25*a*, the displacement S2 is positive. If the distal end 23*f* is positioned at an identical side with the female terminal body 22 relative to the proximal end 25*a*, the displacement S2 is negative.

The embodiment requires that a relationship of S1 and S2 is $S1+S2>0$. If the relationship of them is $S1+S2\leqq 0$, the distal end 19*a* is contacted with the proximal end 25*a* earlier or at an identical time.

In the connector 10 of the constitution, when mating the female connector 11 and male connector 12, the protrusion 19, protruding into the hood part 13 of the female housing 14, passes through the guide hole 16B of the front wall 16A in the male housing 16. At this time, the spring 23, as extending forward beyond the front end 22*f* of the female terminal body 22, contacts with tab 20 before the protrusion 19 and the spring 25 contact. Between the spring 23 and the tab 20, an arc discharge occurs, and when the protrusion 19 and the spring 25 as original contact parts contact, arc discharge does not generate, so that the protrusion 19 and the spring 25 are prevented from deterioration and damage. Even when the spring 23 and the tab 20 are subjected to deterioration and damage due to an arc discharge, they are not original contact parts, and occurrence of the deterioration causes no problem.

In the embodiment, respective one of the male terminal 15 and the female terminal 17 is formed integrally with respective one of the spring 23 and the tab 20 as dummy contacts, and the connector has a contact protecting structure only by mounting the connecting terminals to the housings. Thus, the connector assembly is improved in durability and reliability.

Figure 4:
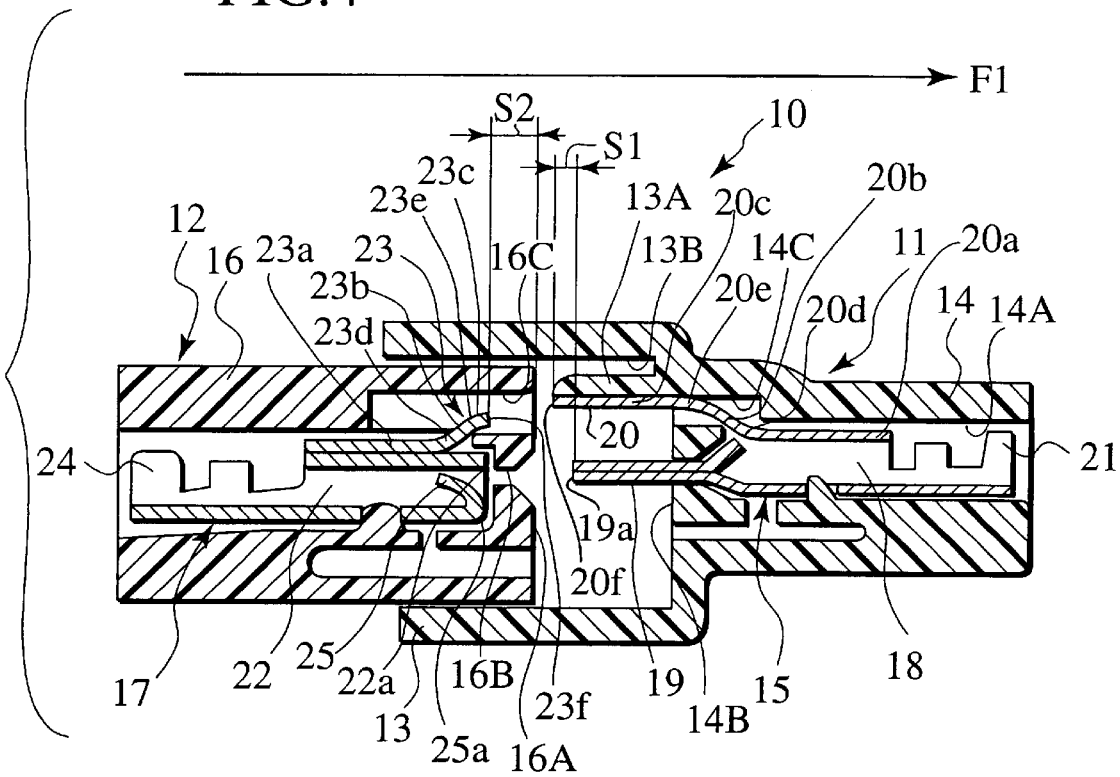
FIG. 4 is a sectional view of another embodiment.
Figure 5:
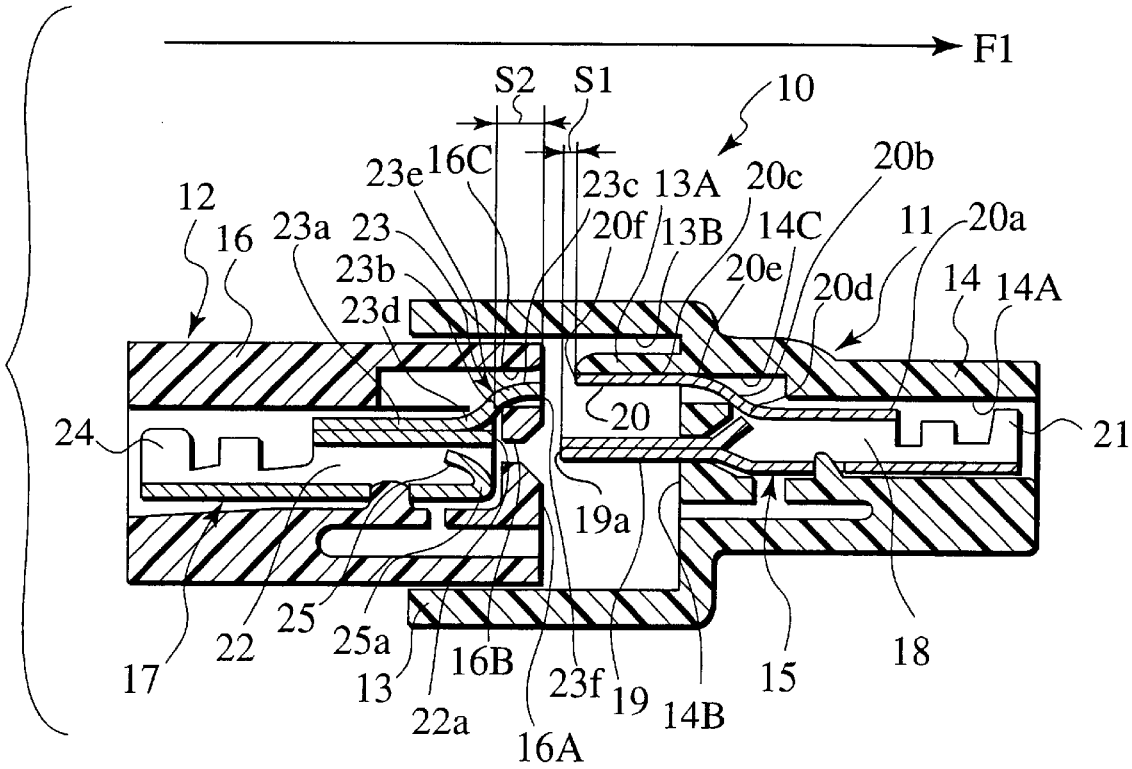
FIG. 5 is a sectional view of another embodiment.

Although the invention has been described above by reference to certain embodiments of the invention, the invention is not limited to the embodiments described above. Modifications and variations of the embodiments described above will occur to those skilled in the art, in light of the above teachings. For example, though the above-described embodiment has the spring 23 extending forward beyond the female terminal body 22, another embodiment is composed such that the spring 23 may be provided to a side part of the terminal body 22 not to extend forward beyond the front end 22*a* of the body 22 and the tab 20 of the other male terminal 15 may extend forward beyond the protrusion 19 as shown on FIG. 4, and the same function and benefit is obtained. In this case, the displacement S1 is positive, and the displacement S2 is substantially zero, so that the sum of the displacements S1 and S2 is positive. As shown on FIG. 5, the end 23*f* of the spring 23 may be displaced from the proximal end 25*a* on an opposite side to the female terminal body 22 and the distal end 20*f* of the tab 20 may be displaced from the distal end 19*a* of protrusion 19 on an identical side with the male terminal body 18. The displacement S1 is negative and the displacement S2 is positive, so that this requires that the absolute value of S2 is greater than one of S1.

Another embodiment is composed such that one of the female and male terminals 15, 17 may be formed with a dummy spring which extends forward to contact with a side part of the other terminal.

The scope of the invention is defined with reference to the following claims.

What is claimed is:

1. A terminal assembly comprising:

a first terminal comprising a contact part, configured to contact for conduction, and a discharge part; and a second terminal comprising a contact part, configured to contact for conduction, and a discharge part;

wherein the discharge parts are configured to contact before the contact parts contact for conduction, and the discharge parts are configured to disengage after the contact parts disengage, and wherein at least one of the discharge parts is spaced from the corresponding contact part in an insulating manner.

2. A terminal assembly comprising:

a first terminal comprising a contact part, configured to contact for conduction, and a discharge part; and a second terminal comprising a contact part, configured to contact for conduction, and a discharge part;

wherein the discharge parts are configured to contact before the contact parts contact for conduction, and the discharge parts are configured to disengage after the contact parts disengage, and wherein the discharge part of the first terminal comprises a spring piece extending forward from a side part of the first terminal in a mating direction.

3. A terminal assembly comprising:

a first terminal having a first contact, the first terminal having a first discharge part with a second contact extending from the first terminal, the first contact being spaced from the first discharge part in an insulated manner, and the second contact being displaced from the first contact at a first displacement, S1; and a second terminal to be mated with the first terminal for conduction, the second terminal having a third contact configured to conduct with the first contact, the second terminal having a second discharge part with a fourth contact extending from the second terminal, the fourth contact configured to conduct with the second contact, the third contact being spaced from the second discharge part in an insulated manner, and the fourth contact being displaced from the third contact at a second displacement, S2, wherein a relationship of the first displacement S1 and the second displacement S2 is that S1+S2>0.

4. A terminal assembly comprising:

a first terminal having a first contact, the first terminal having a first discharge part with a second contact extending from the first terminal, the second contact being displaced from the first contact at a first displacement, S1; and a second terminal to be mated with the first terminal for conduction, the second terminal having a third contact to be contacted with the first contact, the second terminal having a second discharge part with a fourth contact extending from the second terminal, the fourth contact to be contacted with the second contact, the fourth contact being displaced from the third contact at a second displacement, S2, wherein a relationship of the first displacement, S1, and the second displacement, S2, is that S1+S2>0, and wherein the first terminal has a protrusion including the first contact at a distal end thereof.

5. A connector assembly adapted for a terminal assembly according to claim 3, comprising:

a first connector including a first housing accommodating the first terminal; and a second connector including a second housing to be mated with the first housing, the second housing accommodating the second terminal.

* * * * *